United States Patent [19]

Marino

[11] Patent Number: 4,703,517

[45] Date of Patent: Oct. 27, 1987

[54] CARGO BAG WITH INTEGRAL LIFTING LOOPS

[75] Inventor: Frank J. Marino, Hialeah, Fla.

[73] Assignee: Marino Technologies, Inc., Hialeah, Fla.

[21] Appl. No.: 865,688

[22] Filed: May 22, 1986

[51] Int. Cl.[4] ..... B65D 33/14; B65D 88/16

[52] U.S. Cl. ..... 383/7; 383/17; 383/18; 383/20; 383/21; 383/117; 383/119

[58] Field of Search ..... 383/6, 7, 8, 17, 18, 383/20, 22, 24, 117, 119, 121; 112/262.1, 262.2, 10, 423

[56] References Cited

U.S. PATENT DOCUMENTS

| | | | |
|---|---|---|---|
| 4,191,229 | 3/1980 | Skaadel et al. | 383/121 X |
| 4,207,937 | 6/1980 | Sandeman et al. | 383/117 X |
| 4,269,247 | 5/1981 | Omdal | 383/24 X |
| 4,312,392 | 1/1982 | Sekiguchi | 383/7 X |
| 4,362,199 | 12/1982 | Futerman | 383/24 X |
| 4,393,910 | 7/1983 | Rasmussen | 383/8 |
| 4,479,243 | 10/1984 | Derby et al. | 383/121 X |
| 4,493,109 | 1/1985 | Nattrass | 383/7 |
| 4,521,911 | 6/1985 | Vance | 383/20 |
| 4,524,457 | 6/1985 | Marino | 383/7 X |
| 4,610,028 | 9/1986 | Nattrass | 383/7 |

FOREIGN PATENT DOCUMENTS

| | | | |
|---|---|---|---|
| 2803961 | 8/1978 | Fed. Rep. of Germany | 383/8 |
| 2727441 | 5/1979 | Fed. Rep. of Germany | 383/17 |
| 339825 | 12/1930 | United Kingdom | 383/18 |
| 1465695 | 2/1977 | United Kingdom | 383/17 |
| 1525994 | 9/1978 | United Kingdom | 383/117 |

*Primary Examiner*—William Price
*Assistant Examiner*—Sue A. Weaver
*Attorney, Agent, or Firm*—Bell, Seltzer, Park & Gibson

[57] ABSTRACT

Four pairs of lifting panels extend upwardly from and have their lower end portions formed integrally with the upper edges of the side walls of the cargo bag. Each of the four pairs of lifting panels includes a pair of adjacent lifting panels positioned adjacent a corresponding corner of the cargo bag and the upper end portions of the lifting panels are folded inwardly to form multi-plies thereof. The multi-ply upper end portions of adjacent lifting panels are positioned in overlapping relationship and are interconneeted to form a lifting loop above each corner of the cargo bag for supporting and moving the cargo bag from one location to another.

8 Claims, 10 Drawing Figures

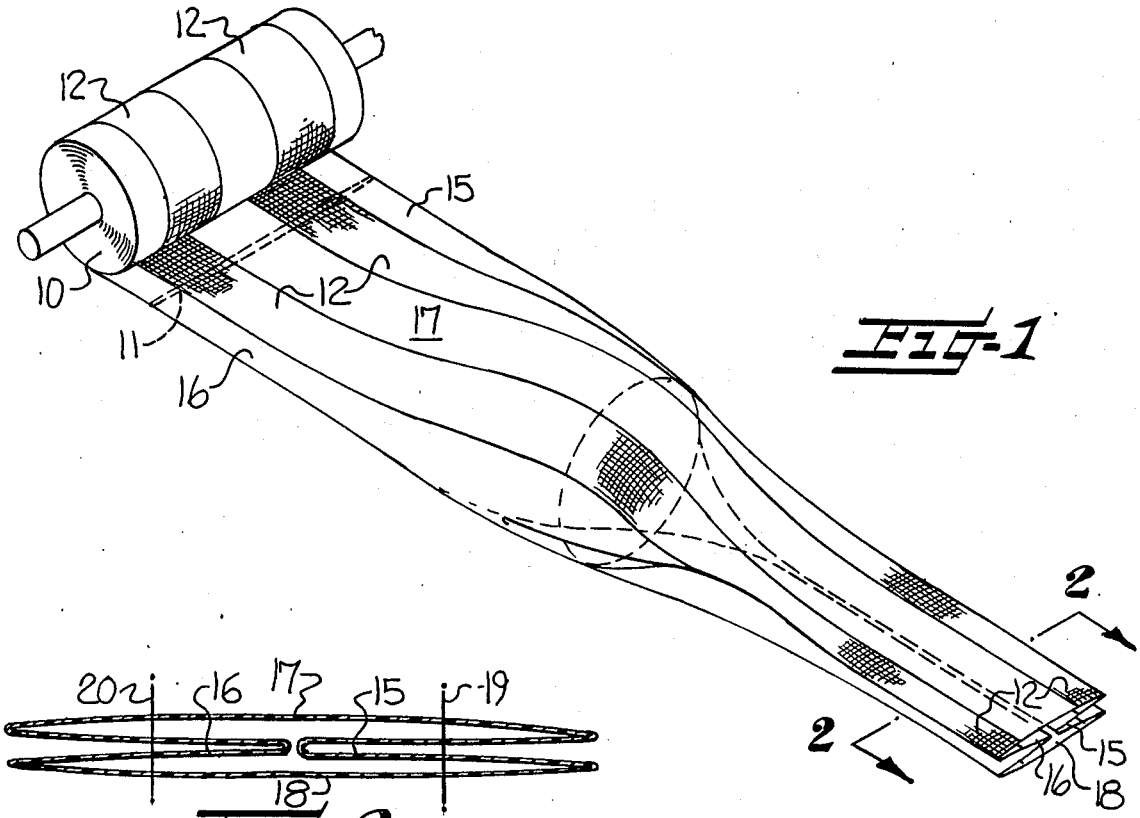
Fig-1
Fig-2
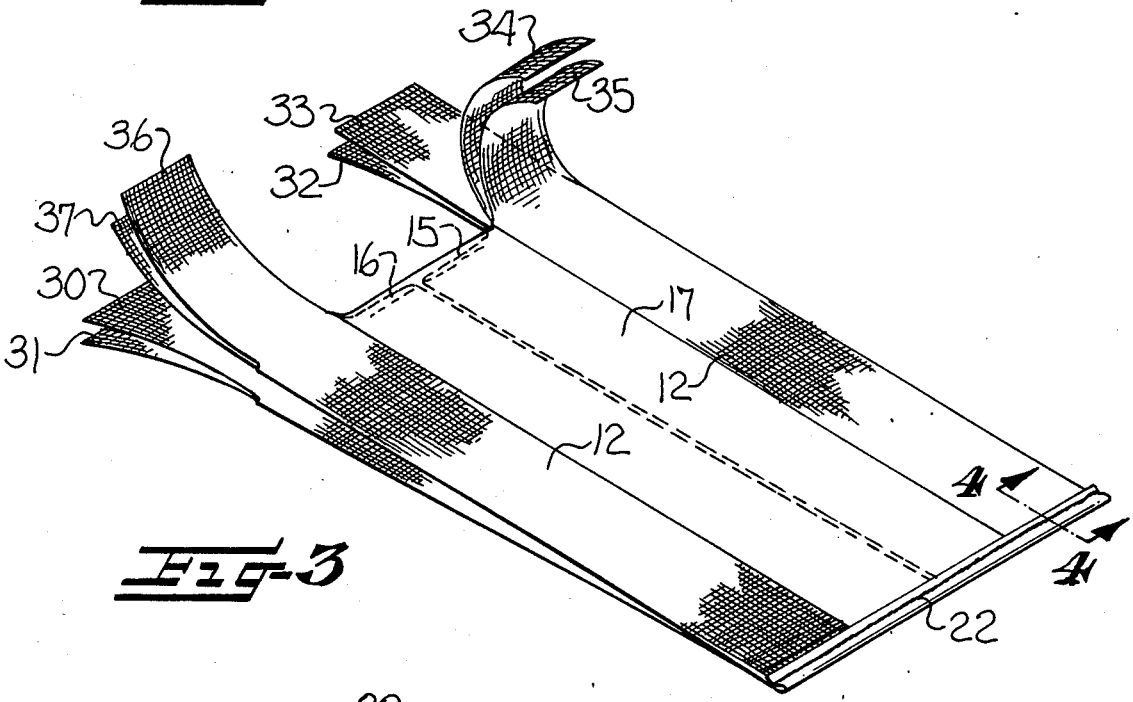
Fig-3
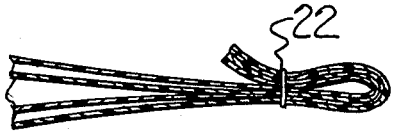
Fig-4

CARGO BAG WITH INTEGRAL LIFTING LOOPS

FIELD OF THE INVENTION

This invention relates generally to a cargo bag of flexible material for transportation and storage of bulk material and more particularly to such a cargo bag which includes a lifting loop adjacent each of the four corners of the bag. Each of the lifting loops is formed by joining together the upper end portions of a pair of lifting panels having their lower end portions formed integrally with and extending upwardly from the upper edges of the side walls and adjacent each corner of the bag so as to distribute the lifting stress over wide areas of the side walls.

BACKGROUND OF THE INVENTION

It is generally known to provide cargo bags with lifting loops which are formed by extensions of the side walls so that they are easily accessible for engagement by the tines of a forklift truck or the hoist straps of a cargo handling crane. U.S. Pat. No. 4,191,229 discloses a cargo bag with two relatively wide lifting loops formed by the folded upper ends of adjacent side walls. These wide lifting loops restrict the size of the upper filling opening and are difficult to be engaged by the tines of a forklift truck or the like. U.S. Pat. No. 4,269,247 also discloses a cargo bag with a pair of lifting loops which are formed by the folded edge of the upper portions of the side walls. The lifting loops of this patent are lashed together by a rope or the like to form a single lifting loop extending upwardly therefrom. The manner in which the pair of lifting loops is formed by the folded upper ends of extensions of the side walls places a severe restriction on the size of the upper filling opening and also concentrates all of the lifting stress on the joined together lifting loops adjacent the center of the cargo bag.

U.S. Pat. No. 4,493,109 is directed to a cargo bag with a lifting loop positioned adjacent each of the four corners of the bag and the lifting loops are formed from sections of the side walls folded around reinforcing bands extending from the bottom to the top of the side walls. The cargo bag disclosed in this patent is difficult to fabricate from rectangular panels because it involves a complicated cutting and sewing operation and also includes seams at each corner, as well as seams in the medial portion of the opposite side walls which are subject to tearing apart when a heavy material is supported in the cargo bag. The cargo bag of U.S. Pat. No. 4,393,910 is formed of either a pair of rectangular panels or four individual rectangular panels folded transversely along a medial portion thereof to provide four integral lifting loops which are direct extensions of the side walls. The lifting loops are each one-fourth of the width of the container's upper filling opening so that they restrict the loading of material into the cargo bag. Also, the construction of the bag in accordance with this patent requires the use of either two or four vertical seams connecting together adjacent side wall panels and these connecting seams form weakened areas in the cargo bag.

U.S. Pat. No. 4,312,392 discloses a cargo bag formed of a single rectangular sheet of material with the upper edge portion being cut to provide a single lifting loop formed by joining together integral extensions of opposite corners of the cargo bag. The medial portion of the upper end of the cargo bag includes a filling opening which is restricted to approximately one-half of the upper circumference of the bag and, therefore, severely restricts the filling opening. Also, the single lifting loop provided in the bag of this patent concentrates the majority of the lifting stress in areas adjacent opposite corners of the bag.

SUMMARY OF THE INVENTION

With the foregoing in mind, it is an object of the present invention to provide a cargo bag with a lifting loop extending above each corner of the cargo bag and being formed by overlapping and interconnected portions of lifting panels formed integral with and extending upwardly from the upper edges of the side walls so as to provide an unrestricted upper filling opening, to uniformly distribute the lifting stress around the circumference of the cargo bag, and with the lifting loops being positioned for easy engagement by the tines of a forklift truck or the like.

It is another object of the present invention to provide a cargo bag whereby the bag is of simple construction and may be economically produced while requiring only a few sewing and cutting operations, thereby permitting the production of the present cargo bag at a cost which justifies the one-time use of the cargo bag.

In each illustrated embodiment of the present invention, a lifting loop is provided adjacent each corner of the cargo bag for supporting and moving the cargo bag from one location to another. Each lifting loop is formed by a pair of adjacent lifting panels with their lower end portions being formed integral with and extending upwardly from the upper edge of adjacent side walls of the bag. The upper end portions of the lifting panels are folded inwardly to form multi-plies thereof and the multi-ply upper end portions are positioned in overlapping relationship and are interconnected to form the lifting loops. The cargo bag is preferably formed from a tubular woven blank of flexible material such as woven polypropylene. The inwardly folded upper portions of the lifting panels provide additional strength and reinforcement to the lifting loops formed by the interconnected and overlapping upper end portions of the lifting panels.

In one embodiment of the present cargo bag, adjacent pairs of upwardly extending lifting panels are positioned immediately adjacent each other and at each corner of the bag. In this embodiment, the upper edges of the medial portions of the side walls terminate below the level of the lifting loops. While the primary lifting stress is concentrated at the corners of the bag, the lifting stress spreads out along the corresponding side walls so that the lifting stress is distributed over the entire width of the side walls of the bag when the bag is fully loaded and lifted by the lifting loops.

In another embodiment of the present cargo bag, the adjacent pairs of lifting panels are separated by a section of side wall fabric extending around each corner of the bag so that the lower end portions of adjacent lifting panels are separated from each other. In this embodiment of the cargo bag, the lifting stress is primarily concentrated in areas spaced from the corners and is distributed over the entire width of the side walls when the fully loaded cargo bag is lifted.

In either embodiment of the present cargo bag, a reinforcement webbing material may be attached in a continuous manner along the upper edge of the side walls and over the lifting loops to provide additional reinforcement to the upper end of the bag. The webbing material increases the lifting capacity of the bag while permitting the bag to be formed of relatively light weight woven fabric.

BRIEF DESCRIPTION OF THE DRAWINGS

Other objects and advantages will appear as the description proceeds when taken in connection with the accompanying drawings, in which FIG. 1 is an isometric view illustrating a roll of tubular woven fabric and illustrating the manner in which the tubular fabric is gusset-folded on opposite sides in preparation for forming a cargo bag blank therefrom;

FIG. 2 is an enlarged transverse sectional view taken substantially along the line 2—2 in FIG. 1;

FIG. 3 is an isometric view of a cargo bag blank which has been seamed across the lower end to form the bottom of the bag and die cut through the multiple folded layers at the upper end thereof to form eight lifting panels integral with and extending upwardly from the side walls;

FIG. 4 is an enlarged sectional view taken substantially along the line 4—4 in FIG. 3;

DESCRIPTION OF THE ILLUSTRATED EMBODIMENTS

Figure 5:
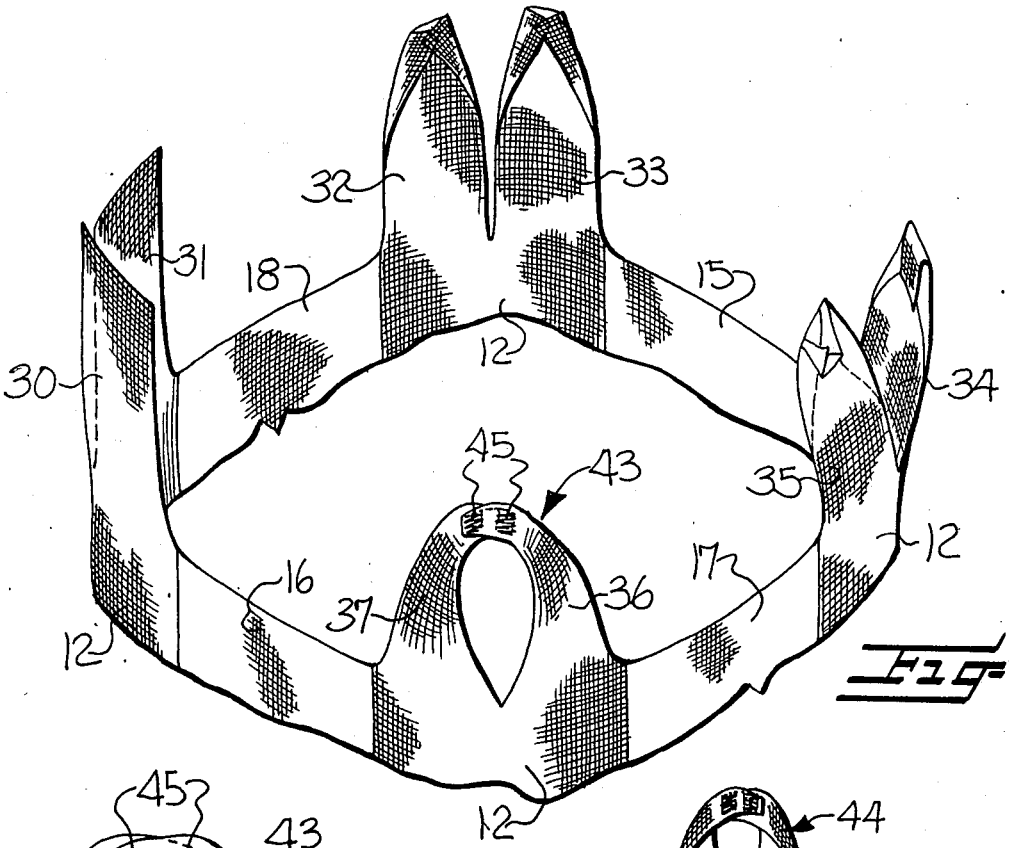
FIG. 5 is a fragmentary isometric view of the upper portion of the cargo bag blank and illustrating the manner in which the lifting loops are formed by folding, overlapping and connecting together the upper end portions of the lifting panels adjacent each corner of the bag.
Figure 6:
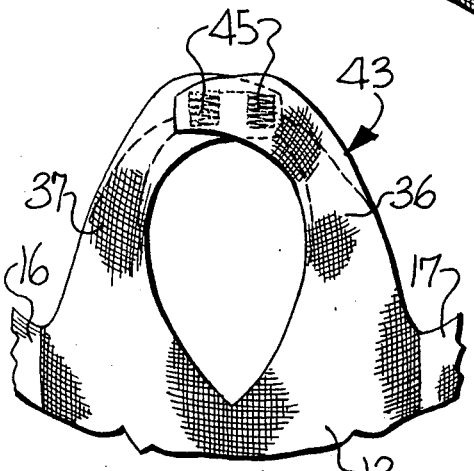
FIG. 6 is an enlarged fragmentary isometric view of a lifting loop formed at one corner of the cargo bag.

Generally, the cargo bag of the present invention is formed of a woven tubular blank of flexible material. The tubular blank may be woven of polypropylene yarns with the filling yarn extending around the tubular blank and the warp yarns extending longitudinally thereof. The woven polypropylene yarns afford strength and durability to the cargo bag and the inner surface may be provided with a layer of plastic film material adhered thereto to serve as a flexible moisture barrier so that the bulk material within the bag is protected during transportation and storage. Alternatively, a plastic film bag may be inserted inside of the tubular blank to provide a flexible moisture barrier for protecting the bulk material stored and transported in the cargo bag.

The cargo bag includes four upstanding and interconnected side walls defining four corners of the cargo bag and a closed bottom with an upper filling opening. The cargo bag of the present invention is particularly characterized by four pairs of lifting panels (a total of eight lifting panels) having lower end portions formed integrally with and extending upwardly from the upper edge of the side walls. Each of the lifting panels is positioned adjacent a corresponding corner of the cargo bag and has inwardly folded upper end portions forming multi-plies thereof. The multi-ply upper end portions of adjacent lifting panels are positioned in overlapping relationship and are interconnected to form a lifting loop extending above each corner of the cargo bag for supporting and moving the cargo bag from one location to another. The formation of the lifting loops from the lifting panels extending upwardly from the side walls greatly simplifies the manufacture of the cargo bag and provides an economical bag which may be adapted for one-time use. The positioning and arrangement of the lifting panels and the lifting loops formed thereof serves to distribute the weight of the material in the cargo bag over the width of the side walls when the cargo bag is filled and lifted by the lifting loops.

THE EMBODIMENT OF FIGS. 1-7

As illustrated in FIG. 1, the blank for forming the cargo bag is formed of tubular woven fabric which is wound onto a supply roll 10 in flattened condition. The filling yarns, indicated in dotted lines at 11 in FIG. 1, extend around the circumference of the tubular blank while the warp yarns extend longitudinally thereof. It is preferred that groups of heavier or larger warp yarns are incorporated in spaced-apart panels around the circumference of the tubular blank to form reinforcing panels, as indicated at 12 in FIG. 1. As an example, the heavier warp yarns in the reinforced panels 12 may provide a fabric which weighs six ounces per square yard while the lighter or smaller warp yarns in the nonreinforced panels therebetween may provide a fabric which weighs five ounces per square yard. The reinforced panels 12 are positioned around the circumference of the blank in such a manner as to be aligned with the positions where the lifting loops are joined to the side walls, in a manner to be presently described. Providing the reinforced panels 12 in those areas where the lifting loops are connected to the cargo bag permits a reduction in the overall cost of the textile fabric used in producing the tubular blank. However, it is to be understood that the entire tubular blank could be formed with warp yarns of the same weight and size so that the fabric is of uniform weight (six ounces per square yard) throughout its entire circumference.

Opposite folded side edge portions of the flattened tubular blank are folded inwardly, to substantially the center of the tubular blank, as illustrated in the right-hand portion of FIGS. 1 and 2, to form inwardly folded gusset panels 15, 16 (FIG. 2) between an upper layer or panel 17 and a lower layer or panel 18. The gusset panels 15, 16 and the upper and lower panels 17, 18 are later utilized in forming the four upstanding and interconnected side walls of the cargo bag. The vertical spaced-apart dash-dot lines 19, 20 in FIG. 2 indicate the positions of the junctures of the heavier weight reinforced panels 12 with the regular weight nonreinforced panels. The reinforced panels 12 are positioned on the outside portions of the gusset-folded tubular blank and the regular weight panels are positioned between the dash-dot lines 19, 20, and in the medial portion of the gusset-folded tubular blank.

The tubular blank is then transversely cut the required length to form one cargo bag blank, as indicated in FIG. 3. One end of the blank is folded upon itself and seamed with a transverse bottom seam 22 to provide a closed gusseted bottom for the cargo bag. The upper central portion is then cut away by forming a U-shaped cutout therein, as illustrated in FIG. 3. The U-shaped cutout is preferably formed by a heated die cut blade to seal the cut edges of the woven polypropylene fabric. The folded outer edges of the folded blank are then slit lengthwise, as indicated in FIG. 3, to the same depth as the U-shaped cutout in the central portion to form four pairs of lifting panels, indicated at 30–37 in FIG. 3. The lower end portions of the lifting panels 30–37 are integrally formed with and extend upwardly from the upper edges of the corresponding side walls 15–18 when the folded blank is opened, in a manner to be presently described. It will be noted that the lifting panels 30–37 are formed in alignment with the reinforced panels 12.

As a specific but nonlimiting example, it has been found that a cargo bag of the proper size to store and transfer approximately one ton of bulk material can be formed of a tubular blank which is 136 inches in circumference and with the overall length of the cargo bag blank being 77 inches. The depth of the U-shaped cutout and the slits is 17 inches so that the upstanding lifting panels 30–37 extend 17 inches above the upper edges of the side walls of the cargo bag. The reinforced panels 12 are each 16 inches wide while the regular weight panels are each 18 inches wide and each of the lifting panels 30–37 is 8 inches wide. While the dimensions given are satisfactory for storing and transporting one ton of certain types of bulk material, it is to be understood that these dimensions can be varied as desired to transport and store various types and amounts of bulk material.

Figure 7:
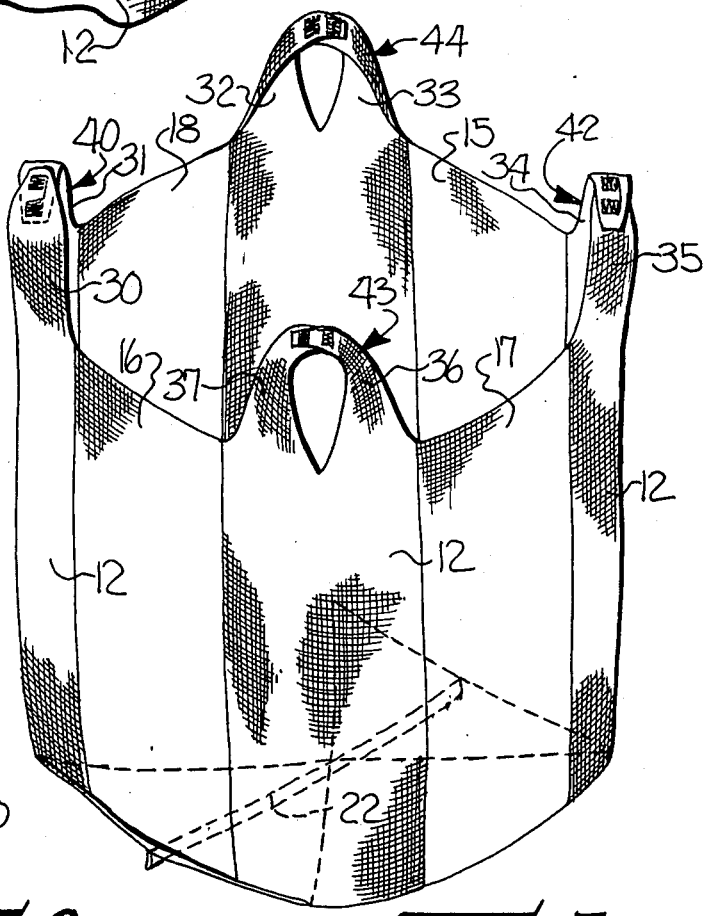
FIG. 7 is an isometric view of the first embodiment of the cargo bag of the present invention with a lifting loop being positioned and extending above each corner of the cargo bag.

When the folded and die cut cargo bag blank is opened, as illustrated in FIG. 5, the four pairs of lifting panels 30–37 extend upwardly above and are positioned immediately adjacent corresponding corners of the cargo bag formed by the interconnected side walls 15–18, as illustrated in the left-hand portion of FIG. 5. The manner in which the four pairs of lifting panels 30–37 are formed into the four lifting loops, broadly indicated at 40–43 in FIG. 7, is illustrated in FIG. 5, it being understood that the lifting loops 40–43 can be formed after the folded blank is opened, as shown in FIG. 5, or while the blank is in the gusset-folded condition illustrated in FIG. 3.

Opposite side edge portions of the upper ends of the adjacent pairs of lifting panels are first folded inwardly in overlapping relationship to form multi-plies thereof, as indicated at the upper ends of the lifting panels 32, 33 in FIG. 5. Then, the upper end portions of the lifting panels are folded over upon themselves and in opposite directions, as indicated at the upper ends of the lifting panels 34, 35 in FIG. 5. The upper end portions of the adjacent lifting panels are then positioned in overlapping relationship and are interconnected in this overlapping relationship, as by zigzag lines of sewing indicated at 45 in FIG. 5, to form a lifting loop above each corner of the cargo bag for supporting and moving the cargo bag from one location to another, as indicated at the upper ends of the lifting panels 36, 37 in FIG. 5, and as shown at each corner of the bag in FIG. 7.

The completed cargo bag thus includes four upstanding and interconnected side walls 15–18 defining four corners of the cargo bag. The cargo bag is provided with a closed bottom, illustrated by the gusseted bottom closed by the seam 22, and an upper filling opening. The lifting loops 40–43 extend above each corner of the cargo bag and are readily accessible for engagement by the tines of a forklift truck, or by the hooks of a lifting hoist or the like. The lifting loops 40–43 stand upwardly above each corner of the cargo bag and provide full access to the upper filling opening in the upper end of the cargo bag so that they do not interfere with the loading of the bulk material into the cargo bag.

If desired, the lower edge of a plastic sleeve, not shown, may be sewn around the upper edges of the side walls 15–18 and gathered together after the bag is filled with bulk material and tied to provide a closed top for the cargo bag. Also, a plastic film bag may be inserted into the cargo bag and filled with bulk material and then closed at the upper end to provide a moisture seal for the bulk material. Alternatively, as has been mentioned, the inner surface of the woven tubular blank may be provided with an impervious film adhered thereto to provide moisture protection for the bulk material in the cargo bag.

Figure 8:
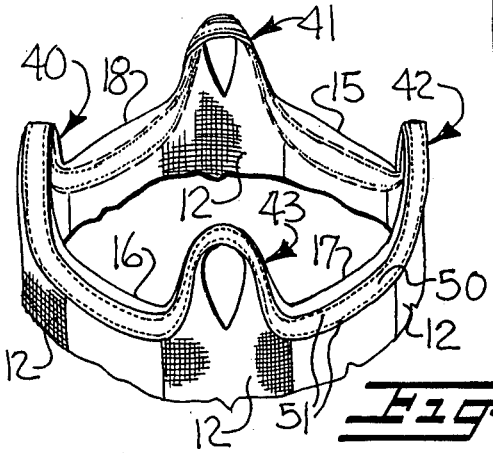
FIG. 8 is a fragmentary view of the upper end of the cargo bag of the type illustrated in FIG. 7 and showing a reinforcing webbing strip sewn to the entire upper peripheral edge of the bag to add reinforcement thereto.

It has been found that a cargo bag as illustrated in FIG. 7 has the required strength for storing and moving bulk material from one location to another while being supported by the lifting loops 40–43. If it is desired to additionally strengthen the lifting loops 40–43 and the upper edge portion of the side walls 15–18, a reinforcing band or strip of woven webbing material, as indicated at 50 in FIG. 8, can be sewn, as by lines of stitching 51, around the entire upper peripheral surface of the cargo bag. The reinforcing webbing 50 thus extends along the upper edge portion of each side wall 15–18 and over each of the lifting loops 40–43.

THE EMBODIMENT OF FIGS. 9 AND 10

Figure 9:
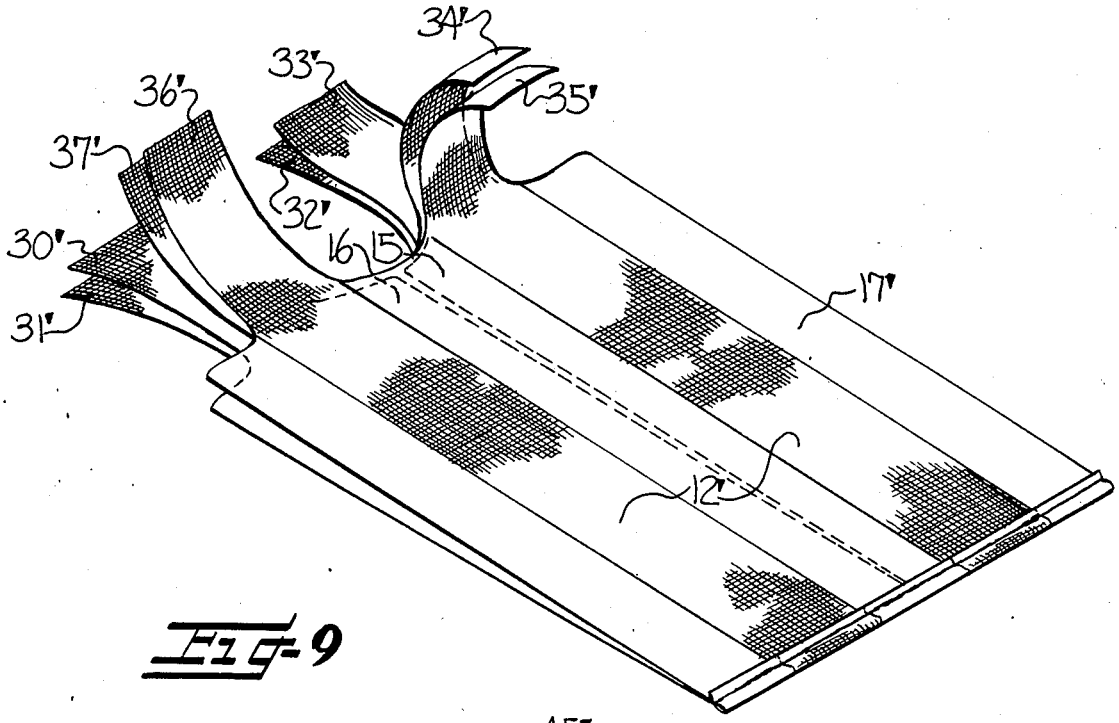
FIG. 9 is an isometric view of a second embodiment of a cargo bag blank with the lifting panels being equally spaced from each other and spaced away from the corners of the bag.
Figure 10:
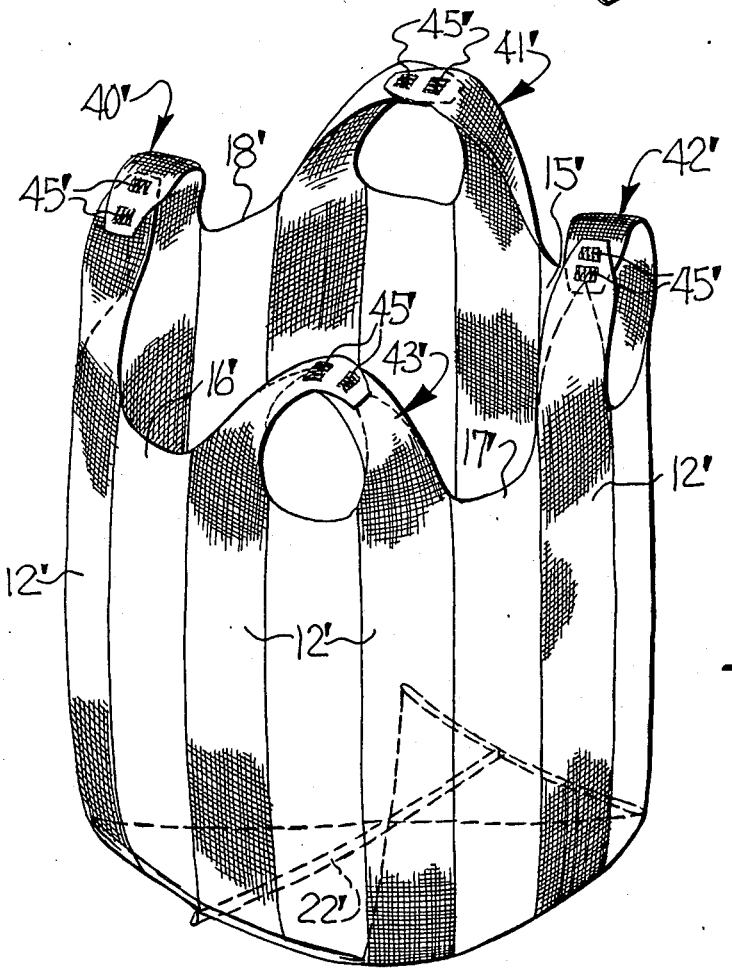
FIG. 10 is an isometric view of the second embodiment of the cargo bag formed of the blank of FIG. 9.

The embodiment of the cargo bag of FIGS. 9 and 10 is very similar to and includes basically the same parts as the embodiment of the cargo bag of FIGS. 1–8 and similar parts of the second embodiment of the cargo bag will bear the same reference characters with the prime notation added as the corresponding parts of the first embodiment of the cargo bag. It will be noted that the cargo bag of FIGS. 9 and 10 is also formed from a tubular blank with opposite sides being folded inwardly and forming gusset panels 15', 16', and being folded along one end and closed by a transverse closure seam 22'. The tubular blank for forming the cargo bag of FIGS. 9 and 10 is woven with reinforced panels 12' alternating with regular weight fabric panels extending completely around the circumference of the tubular fabric.

In this example, the relntorced panels 12' and the alternating regular weight fabric are approximately half as wide as the corresponding panels of the first embodiment. Thus, the reinforced panels 12' are eight inches wide while the regular weight panels are nine inches wide. The upper end portion of the flattened tubular blank is die cut in the central portion with a U-shaped cutout and portions at opposite side edges of the inwardly folded tubular blank are also die cut so that a panel of regular weight fabric is positioned between each of the reinforced panels 12', and a panel of regular weight fabric straddles each corner of the bag. In this case, the four pairs of lifting panels 30'–37' are spaced apart by a nine inch panel of regular weight fabric at each corner of the cargo bag.

The upper end portions of the lifting panels 30'–37' are folded inwardly, overlapped and interconnected in the same manner as that described in connection with the embodiment of FIGS. 1–8 to form lifting loops 40′–43′ extending upwardly and above each corner of the cargo bag formed by the interconnected side walls 15′–18′. The lower ends of the lifting loops 40′–43′ are thus spread apart further than the corresponding lifting loops 40–43 of the cargo bag of FIGS. 1–8 and are spaced outwardly from the corners of the cargo bag so that the primary lifting stress placed on the side walls 15′–18′ is spaced outwardly from the corners of the cargo bag.

In each of the illustrated embodiments of the cargo bag, the four lifting loops are positioned adjacent the corners of the cargo bag and tend to stand upwardly in the manner illustrated so as to provide clear and open access to the upper filling opening of the cargo bag. The four lifting loops are formed by inwardly folding and interconnecting four pairs of lifting panels and the lower end portions of the lifting panels are formed integrally with and extend upwardly from the upper edges of corresponding side walls of the cargo bag. The cargo bag is formed by simply folding opposite side edges of the tubular woven fabric inwardly to form inwardly extending gusset panels, sewing the bottom end of the tubular blank to form a closed bottom, die cutting the upper end of the tubular folded blank to form four pairs of upstanding lifting panels, folding the upper end portions of the lifting panels inwardly to form multi-plies thereof, positioning the same in overlapping relationship, and interconnecting them to form the four lifting loops.

In each embodiment of the cargo bag, the width of the lower end portion of each of the lifting panels (eight inches) is equal to approximately one-seventeenth of the distance around the entire circumference of the cargo bag (one hundred thirty-six inches). The inward folding of the upper end portions of the lifting panels reduces the width of the overlapped portions forming the lifting loop to approximately four inches so that the width of the lifting loop is one-half the width of the bottom portion of the lifting panel. This reduction of the width of the upper portion of the lifting panels, in the area where the lifting loop is formed, makes it easier to insert the tines of a forklift into the lifting loops, or to attach the hoisting rig of a crane or the like thereto.

In the drawings and specification there has been set forth the best modes presently contemplated for the practice of the present invention, and although specific terms are employed, they are used in a generic and descriptive sense only and not for purposes of limitation, the scope of the invention being defined in the claims.

That which is claimed is:

1. A cargo bag of flexible material for transportation and storage of bulk material and including four upstanding and interconnected side walls defining four corners of said cargo bag, a closed bottom, and an upper filling opening, said cargo bag being characterized by four pairs of lifting panels, each of said lifting panels including upper and lower end portions and opposed side edges, said lower end portions of each of said lifting panels being formed integrally with and extending upwardly from the upper edge of said side walls, each of said four pairs of lifting panels being positioned on and extending upwardly from a corresponding corner of said cargo bag, adjacent edges of the lower portions of each of said four pairs of lifting panels being positioned immediately adjacent each other at a corresponding corner of the upper edge of said side walls, said upper end portions of adjacent lifting panels being positioned in overlapping relationship, and means interconnecting said overlapping upper end portions of said adjacent lifting panels and forming a lifting loop above each corner of said cargo bag for supporting and moving said cargo bag from one location to another.

2. A cargo bag according to claim 1 wherein each of said lifting panels includes inwardly folded upper end portions forming multi-plies thereof.

3. A cargo bag according to claim 1 including reinforcing webbing material extending continuously around the upper peripheral edges of said side walls and along and above said lifting loops, and means securing said reinforcing webbing to the upper peripheral edges of said side walls and along said lifting loops.

4. A cargo bag according to claim 1 wherein said means interconnecting said overlapping upper end portions of said adjacent lifting panels comprises stitching penetrating said overlapping upper end portions of said adjacent lifting panels to interconnect the same and form said lifting loops.

5. A cargo bag according to claim 1 wherein said flexible material comprises a tubular woven blank.

6. A cargo bag according to claim 5 wherein said tubular woven blank is provided with four reinforced panels of heavier fabric alternating with four panels of regular weight fabric, each of said reinforced panels extending around a corresponding corner of said cargo bag, and wherein said four pairs of immediately adjacent lifting panels are formed of upward extensions of said corresponding reinforced panels extending around the corresponding corners of said cargo bag.

7. A cargo bag according to claim 6 wherein said reinforced panels are the same width as the width of a pair of adjacent lifting panels.

8. A cargo bag according to claim 1 wherein the width of the overlapped upper end portions of said lifting panels is approximately one-half the width of the lower end portions of said lifting panels.

* * * * *